US006132131A

United States Patent [19]

Nakamura et al.

[11] Patent Number: 6,132,131

[45] Date of Patent: Oct. 17, 2000

[54] ATTACHMENT MOUNTING/DEMOUNTING DEVICE IN WORKING MACHINERY

[75] Inventors: Kazuyuki Nakamura, Tokyo; Junji Sato, Nishinomiya, both of Japan

[73] Assignees: Shin Caterpillar Mitsubishi Ltd., Tokyo; Konan Electric Company Limited, Nishinomiya, both of Japan

[21] Appl. No.: 09/166,541

[22] Filed: Oct. 5, 1998

[51] Int. Cl.[7] ..... E02F 9/00

[52] U.S. Cl. ..... 403/322.1; 403/322.3; 403/325; 37/468

[58] Field of Search ..... 403/322.1, 322.3, 403/325, 37, 38, 31; 172/681, 753; 37/468

[56] References Cited

U.S. PATENT DOCUMENTS

| | | | |
|---|---|---|---|
| 4,881,867 | 11/1989 | Essex et al. | 403/322.3 X |
| 5,082,389 | 1/1992 | Balemi | 403/325 X |
| 5,179,794 | 1/1993 | Ballinger | 403/322.3 X |
| 5,549,440 | 8/1996 | Cholakon et al. | 37/468 X |
| 5,692,325 | 12/1997 | Kuzutani | 37/468 |

FOREIGN PATENT DOCUMENTS 9-209391 8/1997 Japan .

*Primary Examiner*—Lynne H. Browne
*Assistant Examiner*—John R. Cottingham
*Attorney, Agent, or Firm*—Oliff & Berridge, PLC

[57] ABSTRACT

Disclosed is an attachment mounting/demounting device for working machinery by which a pin of an attachment held in engagement with an engagement groove of the mounting/demounting device can be surely locked and operation for locking and unlocking the pin can be easily performed. The mounting/demounting device comprises a latch capable of switching over between a release posture allowing a first pin to come into and out of a first engagement groove and an engagement posture preventing slip-off of the pin fitted to the engagement groove, a lock piston capable of switching over between a lock posture locking the latch in the engagement posture and an unlock posture releasing the latch from the lock posture, and a biasing spring for always biasing the lock piston toward the lock posture. Pressure oil is supplied to the lock piston for switching it over from the lock posture to the unlock posture in response to the pressure oil being supplied to a mounting/demounting cylinder for switching over the latch from the engagement posture to the release posture.

13 Claims, 9 Drawing Sheets

ATTACHMENT MOUNTING/DEMOUNTING DEVICE IN WORKING MACHINERY

BACKGROUND OF THE INVENTION

1. Field of Invention

The invention relates to working machinery, used for a variety of jobs in construction and civil engineering projects.

2. Description of Related Art

Generally, with some working machinery, such as hydraulic shovels, working attachments, such as a bucket, grapple and breaker, are selectively replaceable depending on the type of work to be done, e.g., excavation, loading and cracking. When an attachment mounted to, for example, the fore end of an arm of a hydraulic shovel is replaced, considerable labor and time are required because of the need to remove and insert pins which couple the arm and the attachment, and then securing the pins.

Hitherto, there is known an attachment mounting/demounting device 30 constructed to mount and demount an attachment with a hydraulic force, as shown in FIG. 9. The attachment mounting/demounting device 30 is made up of a bracket 33 supported to the arm side through first and second support pins 31, 32, a rocker arm 34 supported by the second support pin 32 in a rockable manner, and a hydraulic cylinder 35 interposed between the rocker arm 34 and the bracket 33. The bracket 33 and the rocker arm 34 have engagement grooves 33*a*, 34*a* formed to be engageable with first and second pins 7*a*, 7*b* fixed to the attachment side, respectively. In a condition where the first pin 7*a* is held in engagement with the engagement groove 33*a* of the bracket 33, the hydraulic cylinder 35 is extended to make the second pin 7*b* engaged with the engagement groove 34*a* of the rocker arm 34, whereby the attachment is mounted to the mounting/demounting device 30. On the other hand, by contracting the hydraulic cylinder 35 to disengage the second pin 7*b* from the engagement groove 34*a* of the rocker arm 34, the attachment can be removed from the mounting/demounting device 30.

In the above conventional mounting/demounting device, there is a risk that the pin may be disengaged from the engagement groove when the attachment is mounted and being used, if a larger load than expected is imposed on the contraction side of the hydraulic cylinder or if a check valve for restricting the contraction of the hydraulic cylinder should fail to function. To counter, and prevent, such an event from happening, some devices are constructed to mechanically lock the pin, which is held in engagement with the engagement groove, by using a lock member such a lock bolt or lock pin. These devices however require the work of mounting or demounting the bolt or pin to lock or unlock the lock member, thus resulting in a problem that the mounting and demounting work is troublesome and laborious.

To overcome the above problem, as disclosed in Japanese Unexamined Patent Publication No. 9-209391, a latch is provided which is capable of switching over between a release posture allowing the pin to come into and out of the engagement groove and an engagement posture preventing slip-off of the pin fitted to the engagement groove. The latch is rocked between the release posture and the engagement posture with the extending and contracting operation of the hydraulic cylinder which serves also to angularly move the rocker arm.

In the above related art, the latch is set to preclude switching over to the release posture even if the pin is subjected to a force acting on the pin that would normally cause the pin to disengage from the engagement groove in the event of a failure of the hydraulic cylinder or of the hydraulic circuit. However, if the latch itself, which is held in the engagement posture, strikes against an obstacle, for example, so as to produce a force acting on the latch to rock into the release posture, there is a possibility that the latch may release. For this reason, more reliable measures are required to ensure safety.

SUMMARY OF THE INVENTION

In view of the state of art, the invention has been accomplished with the intent to solve the problems described above. According to the invention, in an attachment mounting/demounting device for mounting an attachment to working machinery in a demountable manner, the mounting/demounting device comprises a bracket supported at the working machinery side, an engagement groove formed in the bracket to be releasably engaged with a pin on the attachment side, a latch capable of switching over between a release posture allowing the pin to come into and out of the engagement groove and an engagement posture preventing slip-off of the pin fitted to the engagement groove, a latch actuator for switching over the latch between the release posture and the engagement posture, a lock member capable of switching over between a lock posture locking the latch, which is in the engagement posture, to hold the latch in the engagement posture and an unlock posture unlocking the latch from the lock posture, biasing means for biasing the lock member toward the lock posture, and posture switching means for switching over the lock member in the lock posture to the unlock posture against the biasing means in response to the latch being switched over from the engagement posture to the release posture.

With the above features, the pin engaged with the engagement groove is double locked by the latch locking the pin and the lock member locking the latch in the engagement posture, resulting in improved reliability. Further, because the lock member is biased, by the biasing means, toward the lock posture and is switched over from the lock posture to the unlock posture in response to the latch being switched over from the engagement posture to the release posture, a time consuming operation for locking and unlocking the lock member is no longer required and working efficiency is improved.

In the above attachment mounting/demounting device, the latch actuator may comprise a hydraulic cylinder operated to extend and contract upon supply of pressure oil thereto for switching over the latch between the release posture and the lock posture, the lock member may comprise a lock piston movable to advance and retract between the lock posture where a piston rod locks the latch, which is in the engagement posture, to hold the latch in the engagement posture and the unlock posture releasing the latch from the lock posture, the biasing means may comprise a spring for always biasing the lock piston toward the lock posture, and the posture switching means may comprise a pressure oil supply means for supplying the pressure oil to the lock piston to switch over the lock piston to the unlock posture against the spring in response to the pressure oil being supplied to the hydraulic cylinder for switching over the latch from the engagement posture to the release posture.

Further, preferably, the latch is supported by a bracket in such a rockable manner as to switch over between the engagement posture to the release posture, and a position at which the latch is supported in a rockable manner is set such that when a force tending to disengage the pin from the engagement groove is applied to the pin, the force acts as a force in the direction to hold the latch, which is in the engagement position, in the engagement position. With these features, even if the force tending to disengage the pin from the engagement groove acts on the pin in the event of a failure of the latch actuator, the force acts as a force holding the latch in the engagement posture, and therefore the pin is prevented from slipping out of the engagement groove.

BRIEF DESCRIPTION OF THE DRAWINGS

The invention will be described with reference to the drawings in which.

DETAILED DESCRIPTION OF PREFERRED EMBODIMENTS

Figure 1:
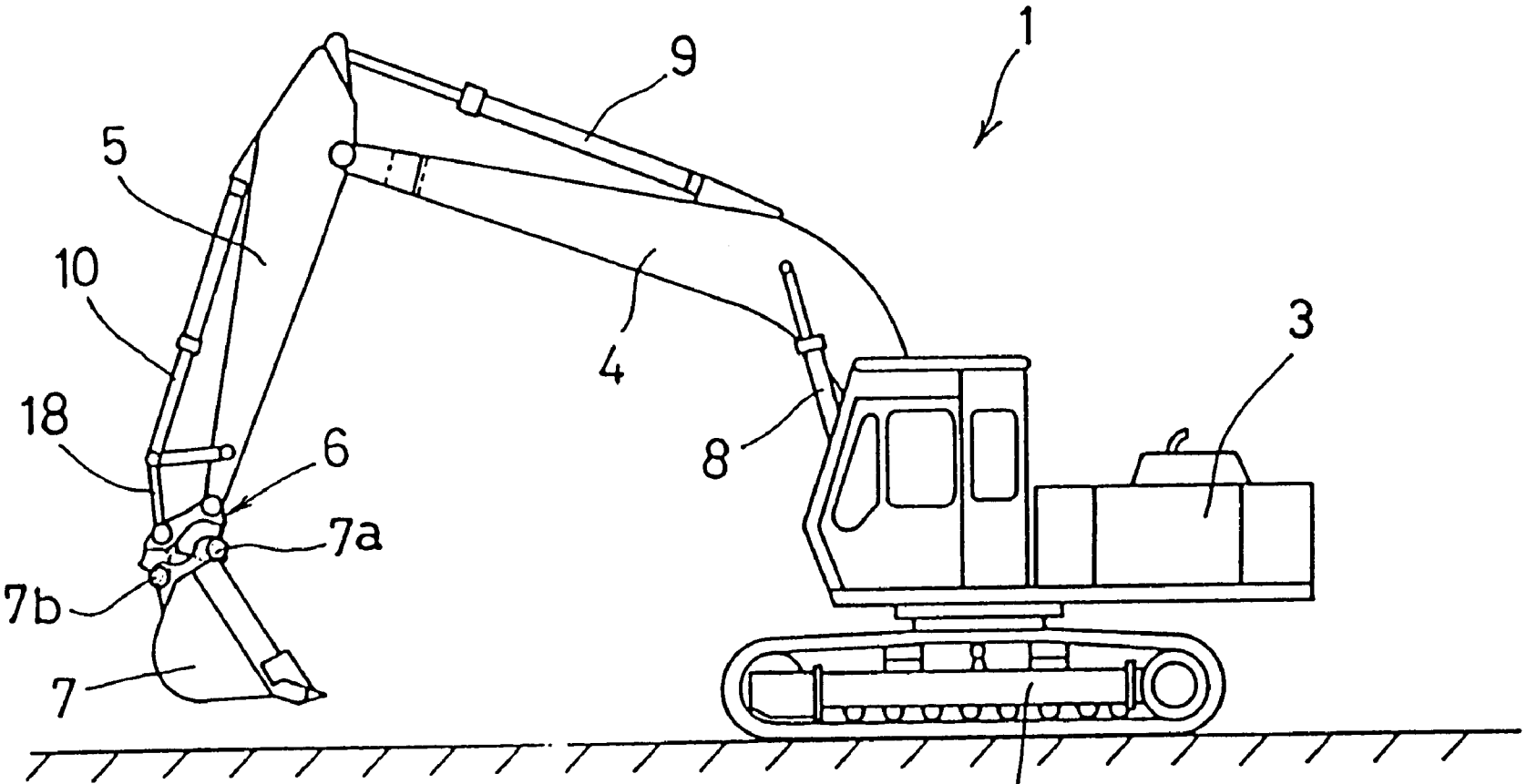
FIG. 1 is a side view of a hydraulic shovel.
Figure 2:
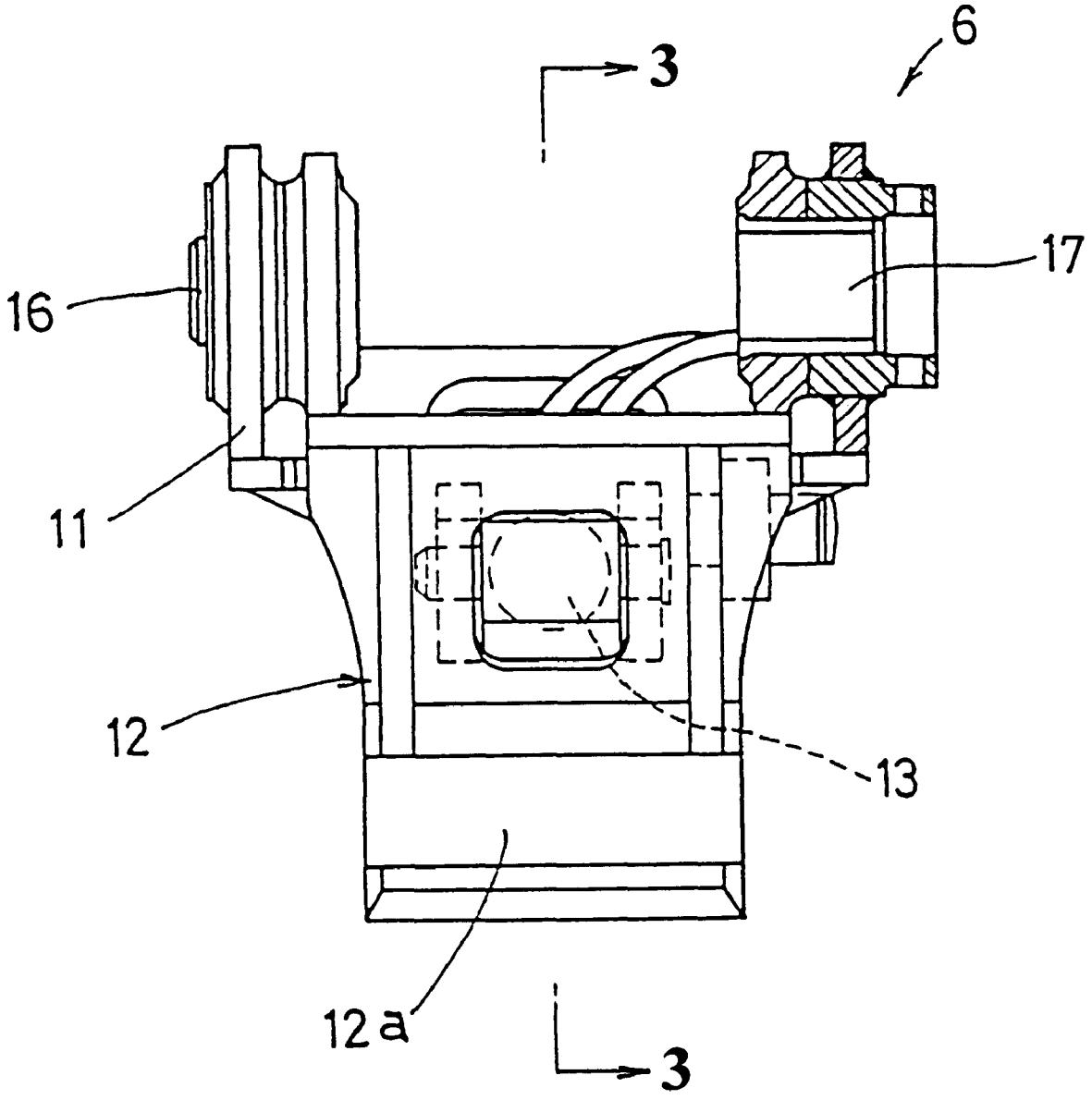
FIG. 2 is a front partly sectional view of a mounting/demounting device.

An embodiment of the invention will be described below with reference to the drawings. In the drawings, the hydraulic shovel 1, used as an exemplary piece of equipment to which this invention is applied, is made up of various constituent members including a crawler type undercarriage 2, an upper revolving structure 3 supported on the undercarriage 2 in a revolvable manner, a boom 4 supported at its base end to the upper revolving structure 3 in a vertically pivotable manner, an arm 5 supported at its base end to the fore end of the boom 4 in a back-and-forth pivotable manner, and an attachment 7 mounted to the fore end of the arm 4 through a mounting/demounting device 6 (described later) in a demountable manner, as well as a boom cylinder 8, an arm cylinder 9 and an attachment cylinder 10 for pivoting the boom 4, the arm 5 and the attachment 7, respectively.

While the attachment 7 in this embodiment is shown as a bucket in FIG. 1, it is not limited to a bucket. Any desired one of various other attachments, such as a breaker or a grapple, can also be mounted with the mounting/demounting device 6 in a demountable manner. First and second pins 7*a*, 7*b* are fixed to an upper portion of the attachment 7 side by side in spaced relation in the front-to-rear direction of boon-arm-attachment assembly.

Figure 3:
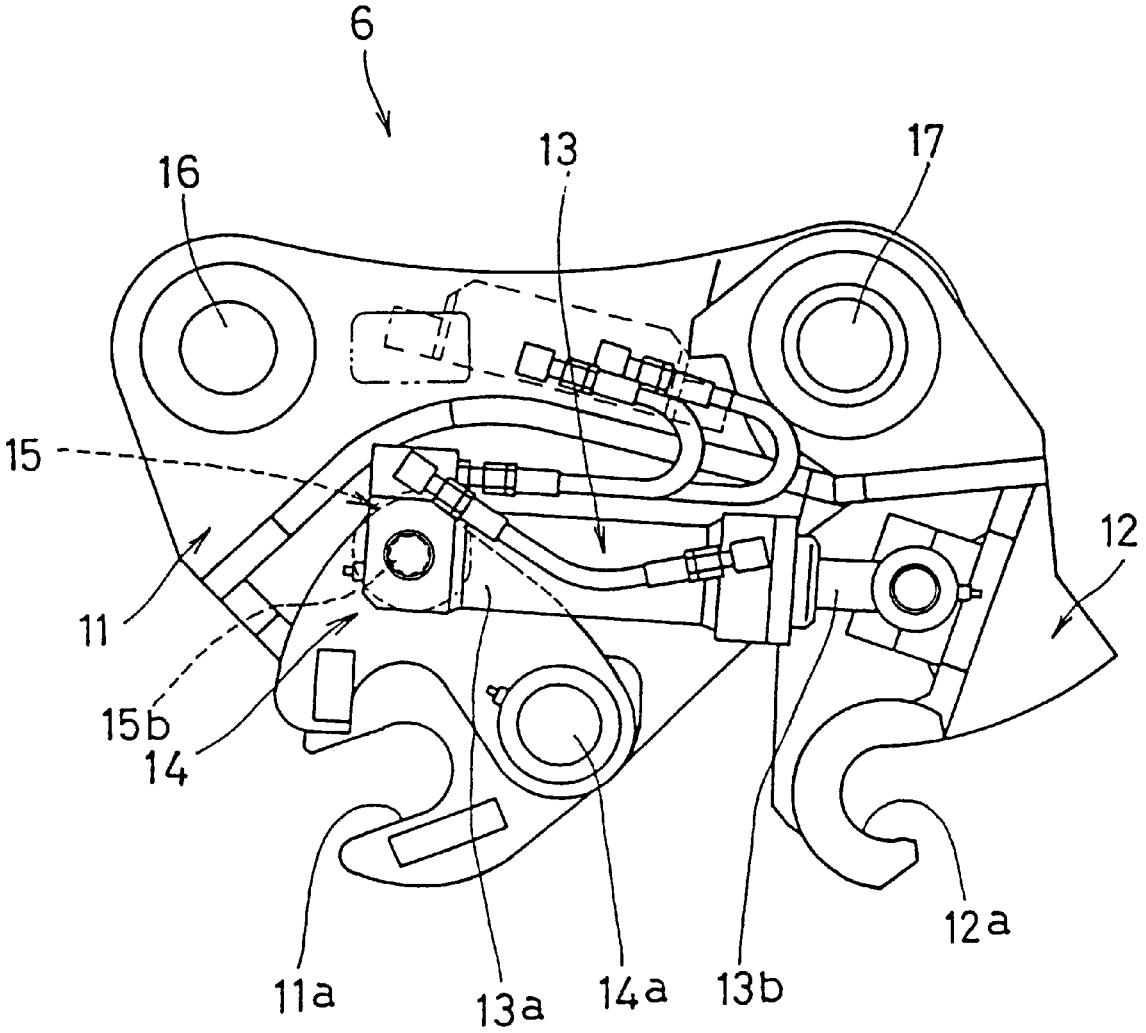
FIG. 3 is view taken along line 3—3 in FIG. 2 when a mounting/demounting cylinder is contracted.
Figure 4:
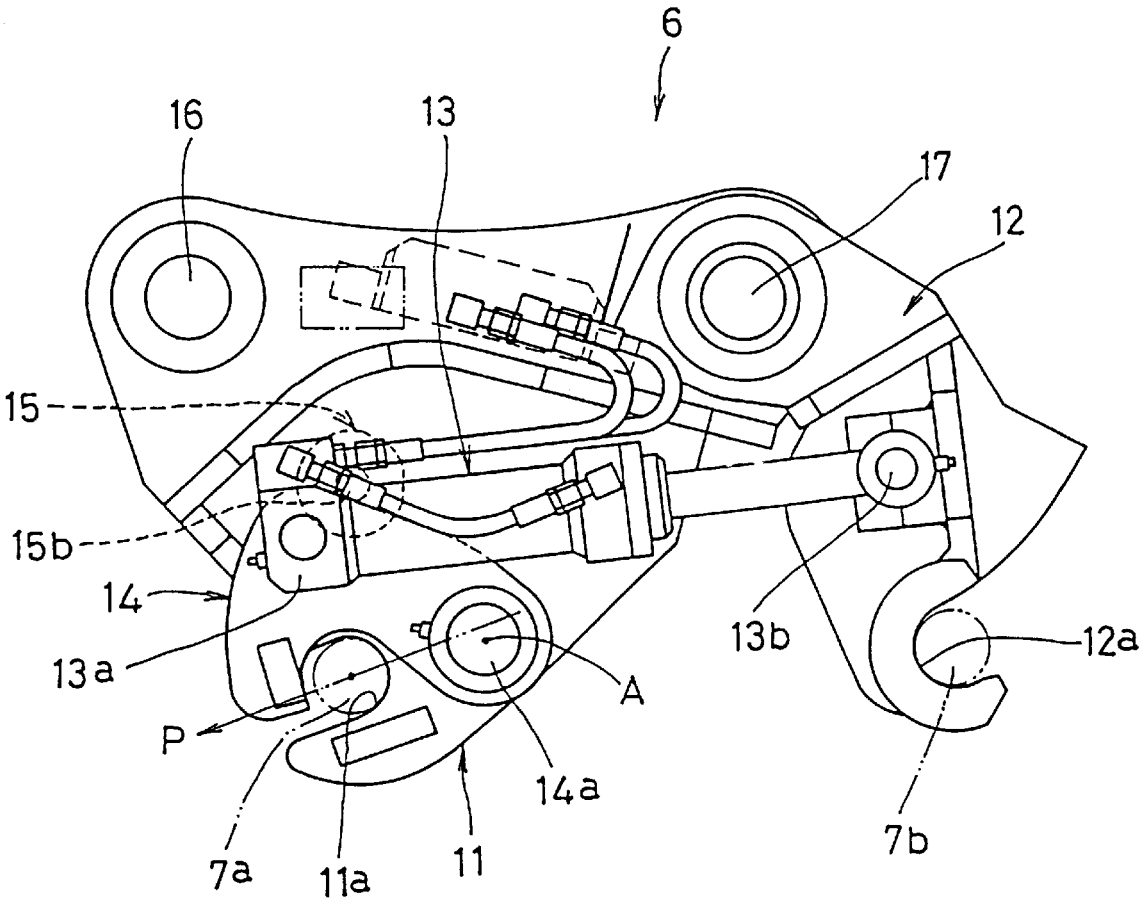
FIG. 4 is view taken along line 3—3 in FIG. 2 when the mounting/demounting cylinder is extended.
Figure 5:
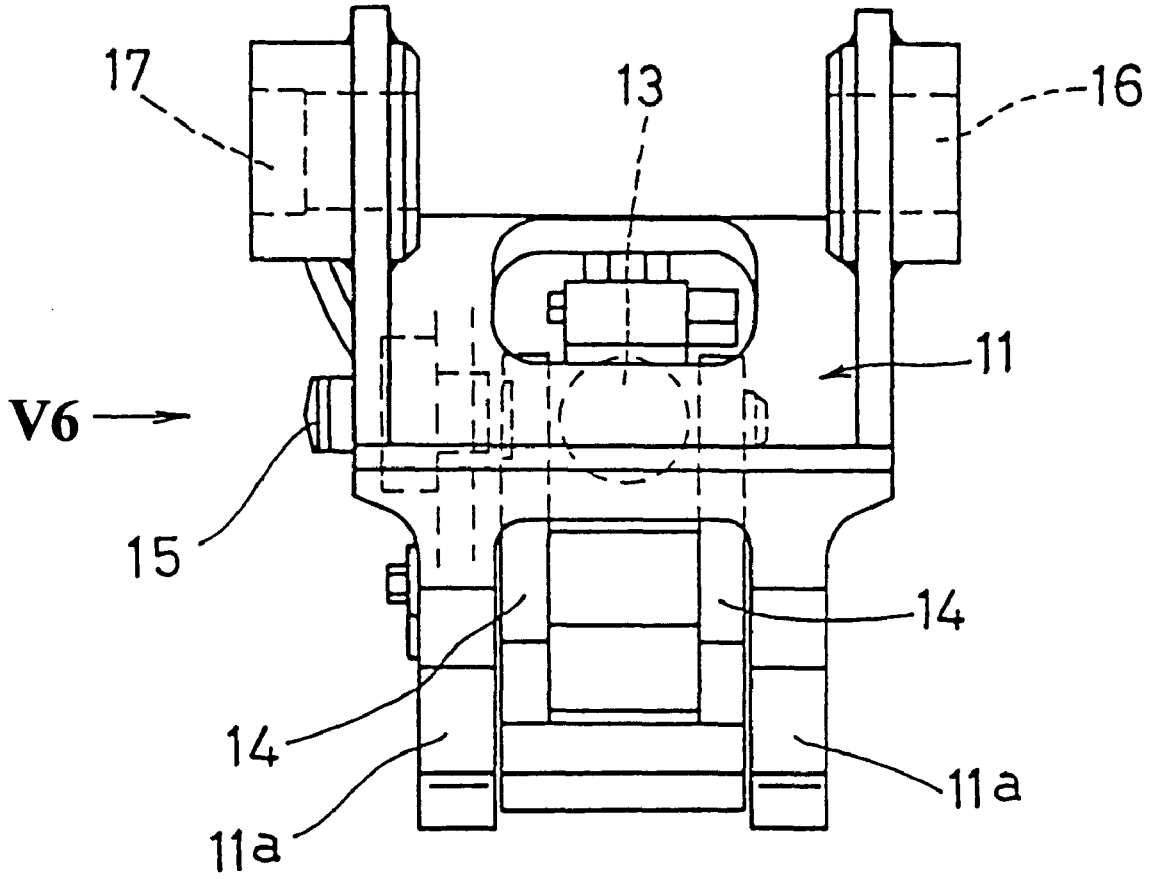
FIG. 5 is a rear view of part of the mounting/demounting device.
Figure 6:
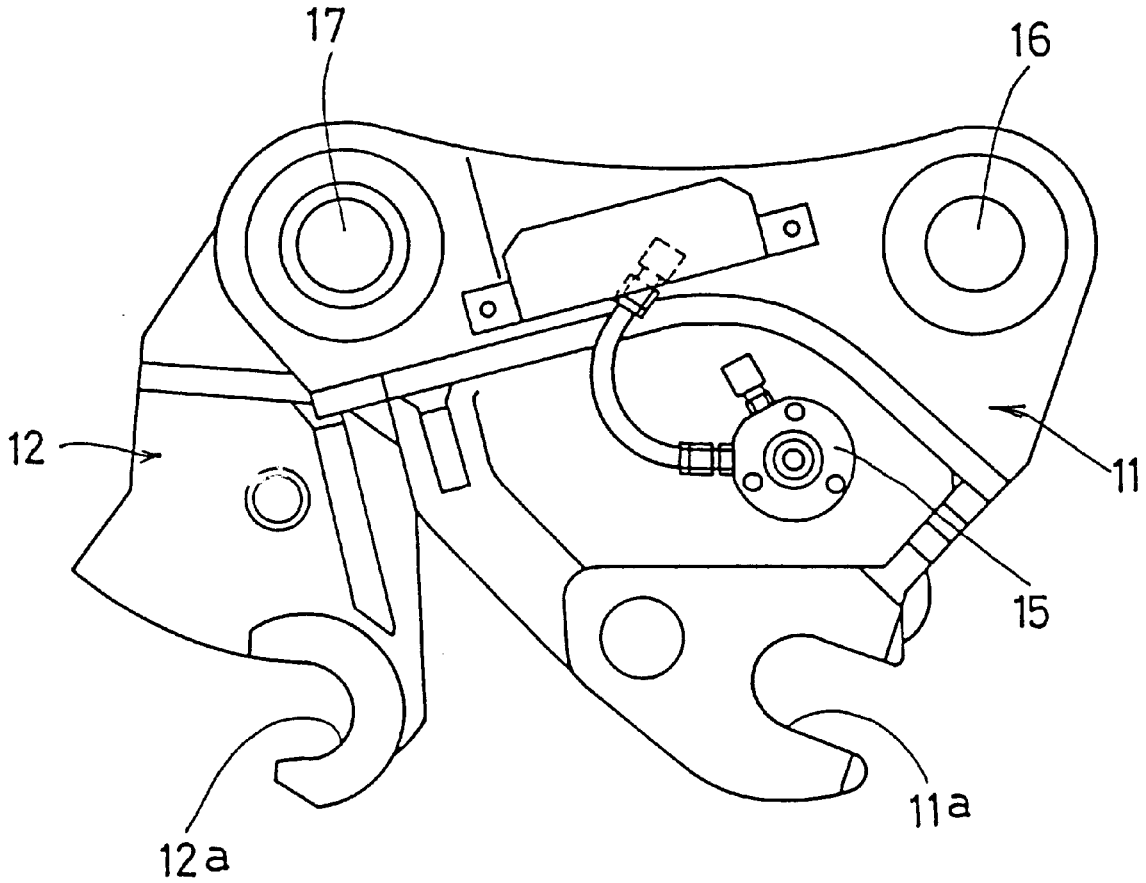
FIG. 6 is a view looking in the direction of arrow V6 in FIG. 5.

The attachment mounting/demounting device 6 has various members including a bracket 11, a rocker arm 12, a mounting/demounting cylinder 13, a latch 14, and a lock piston 15. An upper portion of the bracket 11 is pivotally supported by the fore end of the arm 5 and the fore end of a link rod 18, which is coupled to the attachment cylinder 10, through first and second support pins 16, 17, respectively. The bracket 11 is therefore vertically pivotable about the first support pin 16 upon the attachment cylinder 10 being operated to extend and contract. Further, a pair of left and right first engagement grooves 11*a* are formed in a lower portion of the bracket 11 to be open rearward (toward the left in FIGS. 3 and 4). The first engagement grooves 11*a* are set releasably engaged with the first pin 7*a* of the attachment 7.

The rocker arm 12 is supported at its upper portion by the second support pin 17 in a back-and-forth pivotable manner. A second engagement groove 12*a* in the form of an elongate groove is formed in a lower portion of the rocker arm 12 to be open forward (toward the right in FIGS. 3 and 4). The second engagement groove 12*a* is releasably engaged with the second pin 7*b* of the attachment 7. The rocker arm 12 is capable of rocking to switch over between a mount posture in which the second engagement groove 12*a* is held in engagement with the second pin 7*b* and a demount posture in which the second engagement groove 12*a* is disengaged from the second pin 7*b*, as described later, on the basis of operation of the mounting/demounting cylinder 13 to extend and contract, respectively.

The latch 14 has the form of a hook and is supported at its base end by the bracket 11 in a rockable manner about a pivot shaft 14*a*. Upon the mounting/demounting cylinder 13 being operated to extend and contract, the latch 14 rocks to switch over, as described later, between a release posture in which the first pin 7*a* is allowed to move into and out of the first engagement grooves 11*a*, and an engagement posture in which the distal end of the latch locks the first pin 7*a*, fitted to the first engagement grooves 11*a*, to prevent the slipping-off of the first pin 7*a* from the first engagement grooves 11*a*.

The mounting/demounting cylinder 13 may also be called a hydraulic cylinder in the invention. The mounting/demounting cylinder 13 comprises a cylinder tube 13*a* which is supported at its base end to an intermediate portion of the latch 14, and a piston rod 13*b* which is supported at its distal end to an intermediate portion of the rocker arm 12. As described below, the mounting/demounting cylinder 13 is operated to extend and contract upon the supply of pressure oil. The mounting/demounting cylinder 13 is set such that in a condition where the cylinder 13 is contracted, the latch 14 is in the release posture and the rocker arm 12 is in the demount posture, whereas in the condition where the cylinder 13 is extended, the latch 14 is in the engagement posture and the rocker arm 12 is in the mount posture.

Figure 7A:
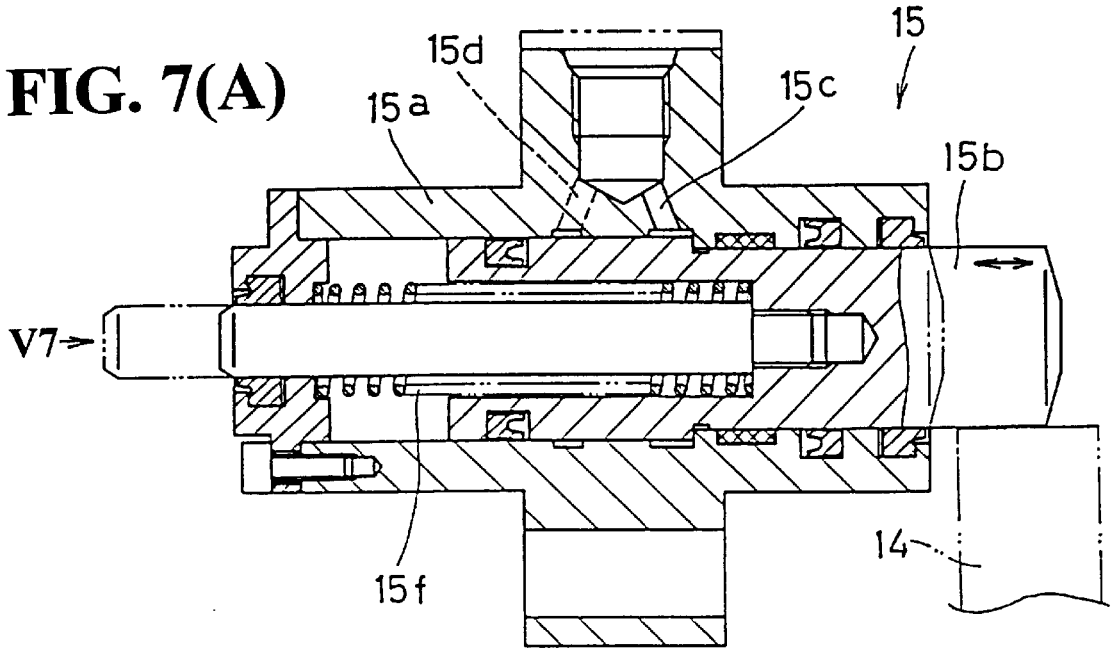
FIG. 7(A) is a sectional view of a lock piston.
Figure 7B:
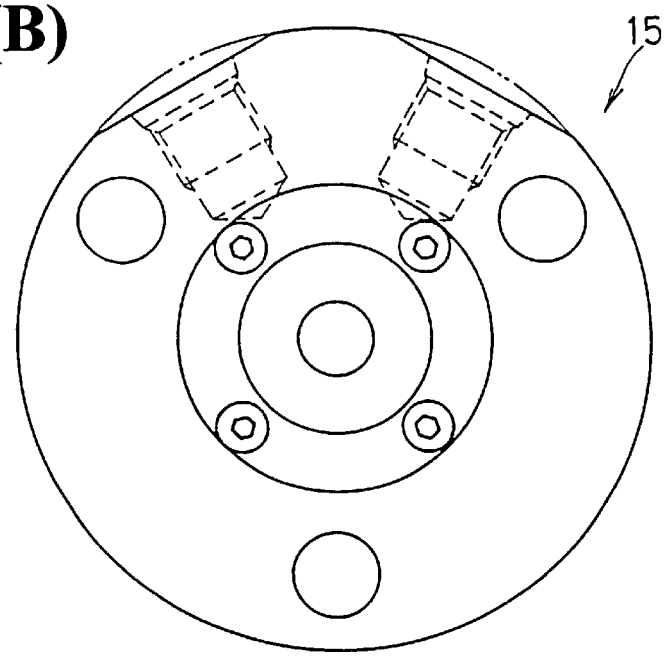
FIG. 7(B) is a view looking in the direction of arrow V7 in FIG. 7(A)

Further, the lock piston 15 (FIG. 7(A)) comprises a cylinder tube 15*a* which is fixed to the bracket 11, and a piston rod 15*b* which is able to advance and retract through one end of the cylinder tube 15*a*. The lock piston 15 is set such that in an advanced or protruded condition of the piston rod 15*b*, it is in a lock posture in which the distal end of the piston rod 15*b* locks the latch 14 in the engagement posture from above, while in a retracted condition of the piston rod 15*b*, it is in an unlock posture in which the distal end of the piston rod 15*b* is separated from the latch 14 to unlock the latch 14.

Here, an axis position A (FIG. 4) of the pivot shaft 14*a* of the latch 14 is located below a line representing the direction of a force P tending to disengage the first pin 7*a* from the first engagement grooves 11*a*. With this arrangement, if the force P, tending to disengage the first pin 7*a* from the first engagement grooves 11*a*, acts on the first pin 7*a* when the latch 14 is in the engagement posture locking the first pin 7*a*, the force P acts as a force tending to rock the latch 14 toward the engagement posture, and therefore the latch 14 is held in the engagement posture. In other words, when the force P tending to disengage the first pin 7*a* from the first engagement grooves 11*a* is applied to the first pin 7*a*, the force P is borne by the latch 14 to prevent undue forces from acting on the mounting/demounting cylinder 13. Furthermore, if the mounting/demounting cylinder 13 should be forced to contract because of a malfunction of a first check valve 24 (FIG. 8) (described below), the first pin 7*a* is locked by the latch 14, held in the engagement posture, and is prevented from slipping out of the first engagement grooves 11*a*.

Figure 8:
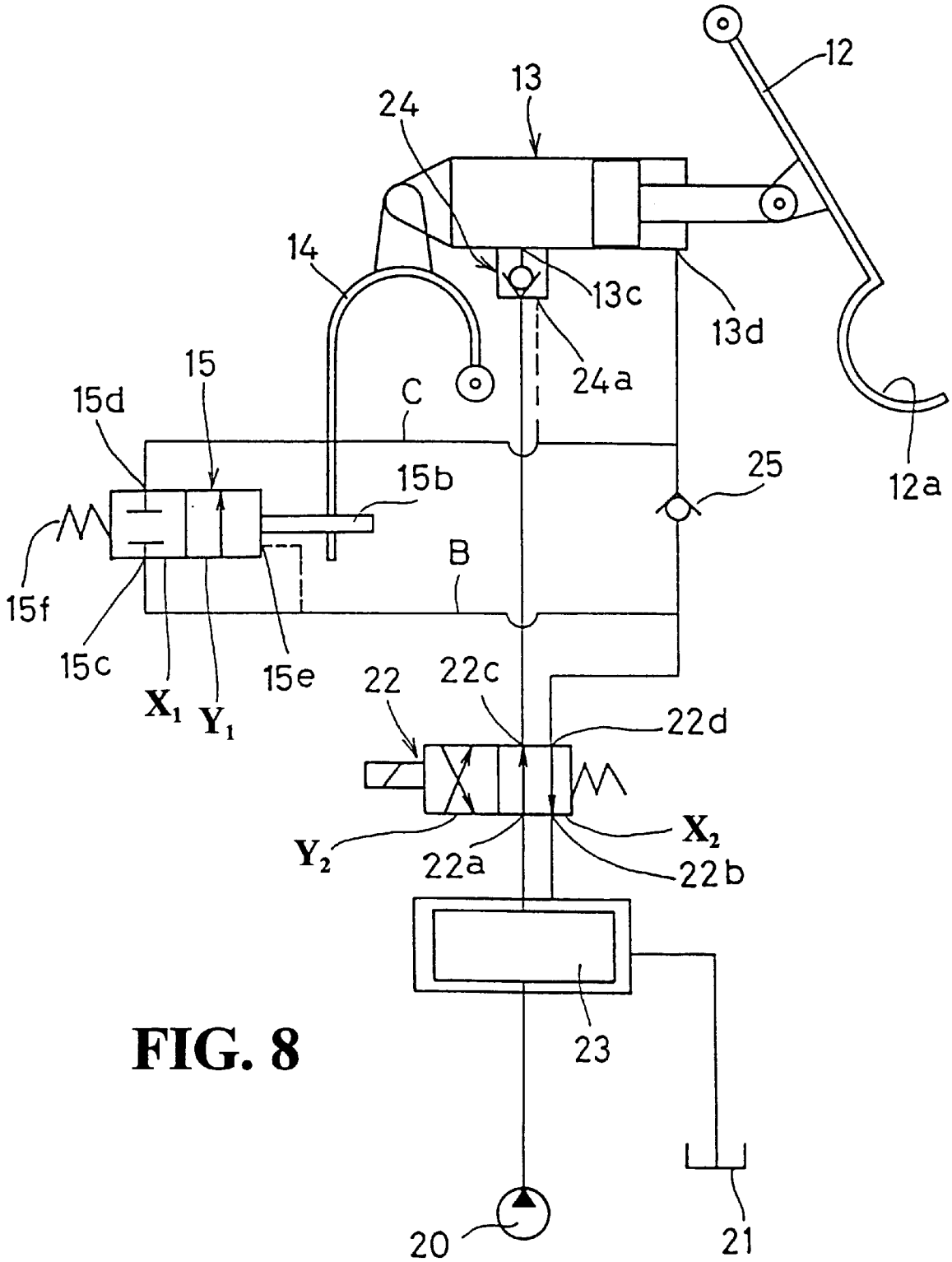
FIG. 8 is a hydraulic circuit diagram for the mounting/demounting cylinder and the lock piston.
Figure 9:
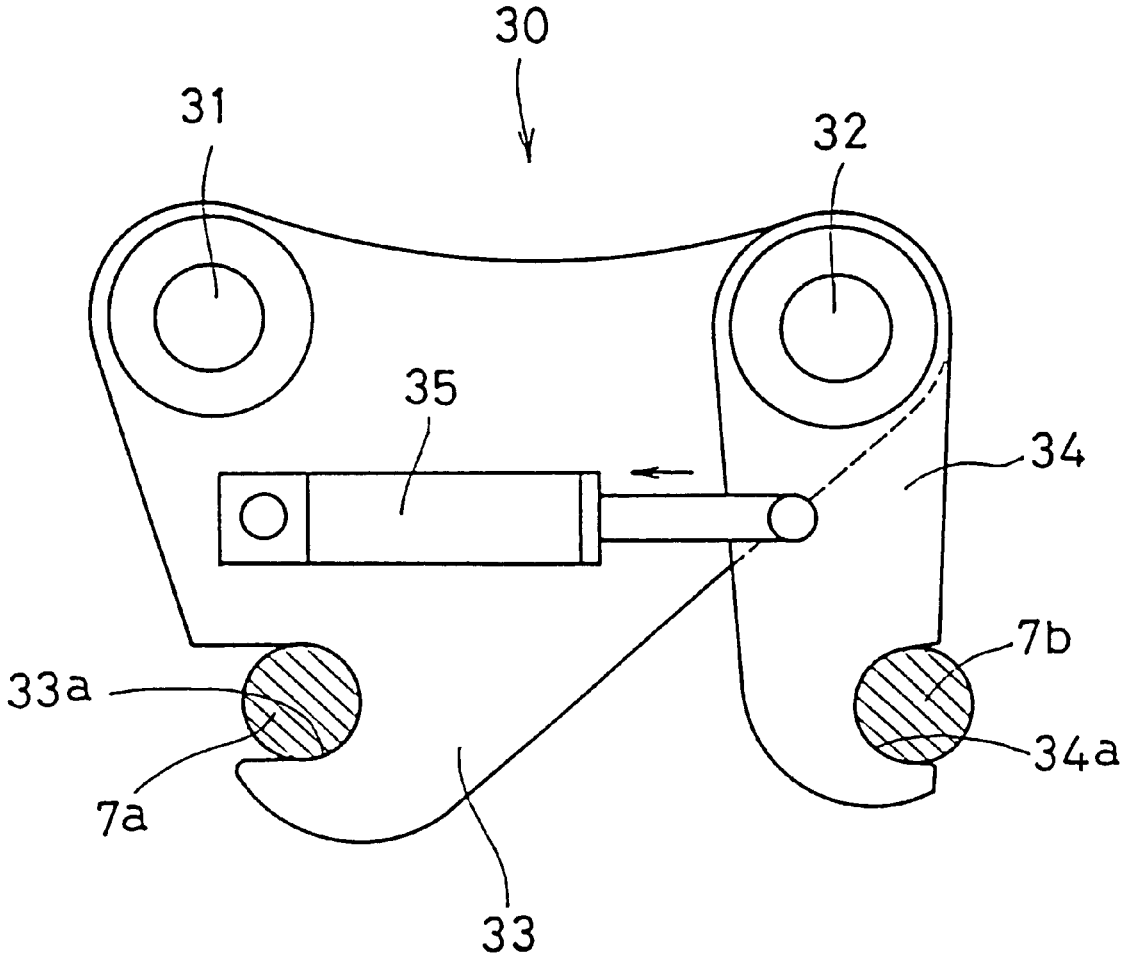
FIG. 9 RELATED ART
FIG. 9 is a view showing a conventional mounting/demounting device.

A pressure oil supply circuit for the mounting/demounting cylinder 13 and the lock piston 15 will now be described with reference to FIG. 8. FIG. 8 shows a hydraulic pump 20, an oil tank 21, a switching valve 22, and a selector valve 23. Supply of the pressure oil to the pressure oil supply circuit is allowed or suspended upon the switching operation of the selector valve 23. The following description applies to the case where the selector valve 23 is shifted to allow the supply of pressure oil.

The mounting/demounting cylinder 13 is provided with an extension side port 13*c* and a contraction side port 13*d*, and is operated to extend and contract upon the pressure oil being supplied to the ports 13*c*, 13*d*.

The lock piston 15 is provided with an inlet port 15*c*, an outlet port 15*d* and a pilot port 15*e*. In a condition where pilot pressure oil under pressure higher than a predetermined value is not supplied to the pilot port 15*e*, the lock piston 15 is in a lock position $X_1$ in which the piston rod 15*b* is held in the lock posture by a biasing force of a biasing spring 15*f*. When the pilot pressure oil under pressure higher than the predetermined value is supplied to the pilot port 15*e*, the lock piston 15 is shifted to an unlock position $Y_1$ in which the piston rod 15*b* is brought into the unlock posture against the biasing force of the biasing spring 15*f*. In this connection, the lock piston 15 is set to close a valve passage leading from the inlet port 15*c* to the outlet port 15*d* when it is in the lock position $X_1$, but open the valve passage when it is in the unlock position $Y_1$.

The inlet port 15*c* is connected to a fourth port 22*d* of the switching valve 22 (described later) through a first oil line B, and the outlet port 15*d* is connected to the contraction side port 13*d* of the mounting/demounting cylinder 13 through a second oil line C. Further, a pilot oil line for supplying the pilot pressure oil to the pilot port 15*e* of the lock piston 15 is branched from the first oil line B, and a pilot oil line for supplying the pilot pressure oil to a pilot port 24*a* of the first check valve 24 (described later) is branched from the second oil line C.

The piston rod 15*b* of the lock piston 15 is brought into the unlock posture upon the pilot pressure oil being supplied to the pilot port 15*e*, as described above. Additionally, in a condition where no pilot pressure oil is supplied to the lock piston 15, the piston rod 15*b* is blocked from advancing and forcibly kept in the unlock posture because the distal end of the piston rod 15*b* is positioned to abut with the latch 14. When the latch 14 is switched over to the engagement position and the piston rod 15*b* is allowed to advance, the piston rod 15*b* forcibly kept in the unlock posture is permitted to switch over to the lock posture automatically under the biasing force of the biasing spring 15*f*.

The switching valve 22 is a 4-port, 2-position solenoid switching valve which is shifted between an extension position $X_2$ and a contraction position $Y_2$ upon an operator selectively manipulating a select switch (not shown). A first port 22*a* is connected to the hydraulic pump 20 through the selector valve 23, and a second port 22*b* is connected to the oil tank 21 similarly through the selector valve 23. A third port 22*c* is connected to the extension side port 13*c* of the mounting/demounting cylinder 13 through the first check valve 24. Further, a fourth port 22*d* is connected to not only the contraction side port 13*d* of the mounting/demounting cylinder 13 through a second check valve 25, but also, as described above, the inlet port 15*c* of the lock piston 15. In a condition where the switching valve 22 is in the extension position $X_2$, a valve passage leading from the first port 22*a* to the third port 22*c* and a valve passage leading from the fourth port 22*d* to the second port 22*b* are opened. Also, in a condition where the switching valve 22 is in the contraction position $Y_2$, a valve passage leading from the first port 22*a* to the fourth port 22*d* and a valve passage leading from the third port 22*c* to the second port 22*b* are opened.

The first check valve 24 is built in the extension side port 13*c* of the mounting/demounting cylinder 13 to allow the pressure oil to flow from the third port 22*c* of the switching valve 22 to the extension side port 13*c* of the mounting/demounting cylinder 13, but block a flow of the pressure oil in the opposite direction. However, the first check valve 24 is also set to allow a flow of the pressure oil in the opposite direction when the pilot pressure oil under pressure higher than the predetermined value is supplied to the pilot port 24*a*. Further, the second check valve 25 is set to allow the pressure oil to flow from the contraction side port 13*d* of the mounting/demounting cylinder 13 to the fourth port 22*d* of the switching valve 22, but block a flow of the pressure oil in the opposite direction.

Accordingly, in the condition where the switching valve 22 is shifted to the extension position $X_2$, the pressure oil from the hydraulic pump 20 is supplied to the extension side port 13*c* of the mounting/demounting cylinder 13 via the selector valve 23, the switching valve 22 and the first check valve 24, while the pressure oil from the contraction side port 13*d* of the mounting/demounting cylinder 13 is drained to the oil tank 21 via the second check valve 25, the switching valve 22 and the selector valve 23. The mounting/demounting cylinder 13 is thereby extended. At this time, since no pressure oil is supplied to the first oil line B and the pilot pressure oil under pressure higher than the predetermined value is not supplied to the pilot port 15*e*, the lock piston 15 is held in the lock position $X_1$ under the biasing force of the biasing spring 15*f*, as described above. Thus, the piston rod 15*b* is held in the lock posture and the valve passage leading from the inlet port 15*c* to the outlet port 15*d* is closed.

On the other hand, in the condition where the switching valve 22 is shifted to the contraction position $Y_2$, the pressure oil from the hydraulic pump 20 is supplied to the first oil line B via the selector valve 23 and the switching valve 22. Upon the pressure oil being supplied to the first oil line B, the pilot pressure oil under pressure higher than the predetermined value is supplied to the pilot port 15*e* of the lock piston 15. Therefore, as described above, the lock piston 15 is shifted to the unlock position $Y_1$ against the biasing force of the biasing spring 15*f* and the piston rod 15*b* is switched over to the unlock posture. Simultaneously, the valve passage leading from the inlet port 15*c* to the outlet port 15*d* is opened, and the pressure oil supplied to the first oil line B is then supplied to the contraction side port 13*d* of the mounting/demounting cylinder 13 via the second oil line C. Further, upon the pressure oil being supplied to the second oil line C, the pilot pressure oil under pressure higher than the predetermined value is supplied to the pilot port 24*a* of the first check valve 24 so that the first check valve 24 allows a flow of the pressure oil from the extension side port 13*c* of the mounting/demounting cylinder 13 to the third port 22*c* of the switching valve 22. As a result, the pressure oil from the extension side port 13*c* of the mounting/demounting cylinder 13 is drained to the oil tank 21 via the first check valve 24, the switching valve 22 and the selector valve 23, whereby the mounting/demounting cylinder 13 is contracted.

The attachment mounting/demounting device thus structured operates as follows. When mounting the attachment 7 to the mounting/demounting device 6, the pressure oil is supplied to the contracted mounting/demounting cylinder 13 to extend it in a condition where the first pin 7*a* of the attachment 7 is engaged with the first engagement grooves 11*a* of the bracket 11. Upon the extension of the mounting/demounting cylinder 13, the rocker arm 12 is brought into the mount posture and the second engagement groove 12*a* is engaged with the second pin 7*b*. The attachment 7 is thereby mounted to the mounting/demounting device 6 in such a state that the first and second pins 7*a*, 7*b* are engaged with and supported by the first and second engagement grooves 11*a*, 12*a*, respectively. Also, upon the extension of the mounting/demounting cylinder 13, the latch 14 is brought into the engagement posture in which the latch locks the first pin 7*a* engaged with the first engagement grooves 11*a* for preventing slip-off of the first pin 7*a* from the first engagement grooves 11*a*. Further, upon the latch 14 being switched over to the engagement posture, the piston rod 15*b* of the lock piston 15 is automatically brought into the lock posture under the biasing force of the biasing spring 15*f*, as described above, thereby locking the latch 14 in the engagement posture.

On the other hand, when demounting the attachment 7 from the mounting/demounting device 6, the mounting/demounting cylinder 13 is contracted to switch over the rocker arm 12 from the mount posture to the demount posture, causing the second pin 7*b* to disengage from the second engagement groove 12*a*. Simultaneously, the latch 14 is switched over from the engagement posture to the release posture, thus allowing the first pin 7*a* to disengage from the first engagement grooves 11*a*. Further, since the pressure oil under higher pressure is supplied to the pilot port 15*e* upon the pressure oil being supplied to the contraction side port 13*d* of the mounting/demounting cylinder 13, the piston rod 15*b* of the lock piston 15 is brought into the unlock posture, as described above, thus allowing the latch 14 to switch over to the release posture.

As a result, in a condition of the attachment 7 being mounted to the mounting/demounting device 6, even if the force P tending to disengage the first pin 7*a* from the first engagement grooves 11*a* acts on the first pin 7*a* in the event of a malfunction of the first check valve 24 which functions to restrict the contraction of the mounting/demounting cylinder 13, the force P acts as a force holding the latch 14 in the engagement posture, as described above, and hence the first pin 7*a* is prevented from slipping out of the first engagement grooves 11*a*. Further, if a force tending to cause the latch 14 to switch over toward the release posture should act on the latch 14 upon, for example, any obstacle hitting against the latch itself, the latch 14 is prevented from switching over to the release posture accidentally because it is locked in the lock posture by the piston rod 15*b* of the lock piston 15. Thus, the first pin 7*a* is locked double by the latch 14 locking the first pin 7*a* and the lock piston 15 locking the latch 14 in the engagement posture. In the above-mentioned accidental cases, therefore, it is possible to positively prevent the first pin 7*a* from slipping out of the first engagement grooves 11*a* and to improve reliability.

Further, because of the lock piston 15 being held in the lock posture under the biasing force of the biasing spring 15*f*, even if there occurs a failure in the mounting/demounting cylinder 13 or the hydraulic circuit thereof, the latch 14 can be locked in the engagement posture regardless of such a failure, and hence reliability is further improved.

Additionally, since the lock piston 15 in the lock posture is automatically switched over to the unlock posture upon the pressure oil being supplied to the contraction side port 13*d* of the mounting/demounting cylinder 13 for removing the attachment 7 from the mounting/demounting device 6, operation for locking and unlocking the lock piston 15 is no longer required, which also contributes to an improvement in work efficiency.

What is claimed is:

1. An attachment mounting/demounting device for working machinery, the device used to mount an attachment to the working machinery in a demountable manner, comprising:

a bracket mounted on the working machinery;

an engagement groove formed in said bracket to be releasably engaged with a pin on the attachment side;

a latch capable of switching over between a release posture allowing said pin to come into and out of said engagement groove and an engagement posture preventing slip-off of said pin fitted to said engagement groove;

a latch actuator for switching over said latch between the release posture and the engagement posture;

a lock member capable of switching over between a lock posture locking said latch, which is in the engagement posture, to hold said latch in the engagement posture and an unlock posture unlocking said latch from the lock posture;

biasing means for always biasing said lock member toward the lock posture; and posture switching means for switching over said lock member in the lock posture to the unlock posture against said biasing means in response to said latch being switched over from the engagement posture to the release posture.

2. The attachment mounting/demounting device for working machinery according to claim 1, wherein said latch actuator comprises a hydraulic cylinder operated to extend and contract upon supply of pressure oil thereto for switching over said latch between the release posture and the lock posture, said lock member comprises a lock piston movable to advance and retract between the lock posture where a piston rod locks said latch, which is in the engagement posture, to hold said latch in the engagement posture and the unlock posture releasing said latch from the lock posture, said biasing means comprises a spring for always biasing said lock piston toward the lock posture, and said posture switching means comprises pressure oil supply means for supplying the pressure oil to said lock piston to switch over said lock piston to the unlock posture against said spring in response to the pressure oil being supplied to said hydraulic cylinder for switching over said latch from the engagement posture to the release posture.

3. The attachment mounting/demounting device for working machinery according to claim 1, wherein said latch is supported by a bracket in a rockable manner to switch over between the engagement posture to the release posture, and a position at which said latch is supported in the rockable manner is set such that when a force tending to disengage said pin from said engagement groove is applied to said pin, said force acts as a force in the direction to hold said latch, which is in the engagement position, in the engagement position.

4. The attachment mounting/demounting device for working machinery according to claim 2, wherein said latch is supported by a bracket in a rockable manner to switch over between the engagement posture to the release posture, and a position at which said latch is supported in the rockable manner is set such that when a force tending to disengage said pin from said engagement groove is applied to said pin, said force acts as a force in the direction to hold said latch, which is in the engagement position, in the engagement position.

5. A lock mounting assembly for securely mounting a work attachment having a pair of spaced apart mounting pins to a work machine, the lock mounting assembly comprising:

a bracket mounted on the work machine having a first engagement groove for receiving a first mounting pin of the pair of mounting pins;

a rocker arm pivotally mounted with respect to the bracket, the rocker arm having a second engagement groove for receiving a second mounting pin of the pair of mounting pins;

a latch pivotally mounted to the bracket, the latch pivoting between an open position opening the first engagement groove and another position substantially closing the first engagement groove;

a mounting/demounting mechanism connected at a first end to the rocker arm and at a second end to the latch; and a lock mechanism mounted to the bracket that retains the latch in the another position to substantially close the first engagement groove when the work attachment is mounted to the work machine.

6. The lock mounting assembly according to claim 5, wherein the mounting/demounting mechanism comprises:

a cylinder;

a piston mounted in the cylinder to define a chamber on each side of the piston; and a port provided in the cylinder on each side of the piston for the introduction and exit of a pressurized medium to an appropriate one of the chambers.

7. The lock mounting assembly according to claim 5, wherein the lock mechanism comprises:

a cylinder;

a piston having a rod mounted in the cylinder and having the rod extending from one end;

a spring mounted in the cylinder on a side of the piston opposite to the rod; and a port provided in the cylinder for introduction and exit of a pressurized medium to a side having the rod.

8. The lock mounting assembly according to claim 6, wherein the lock mechanism comprises:

a cylinder;

a piston having a rod mounted in the cylinder and having the rod extending from one end;

a spring mounted in the cylinder on a side of the piston opposite to the rod; and a port provided in the cylinder for introduction and exit of a pressurized medium to a side having the rod.

9. The lock mounting assembly according to claim 8, further comprising means for controlling the provision of the pressurized medium to the ports of the cylinder of the mounting/demounting mechanism and the port of the lock mechanism.

10. The lock mounting assembly according to claim 7, wherein the spring biases the rod to extend from the end of the cylinder.

11. The lock mounting assembly according to claim 9, wherein the spring biases the rod to extend from the end of the cylinder.

12. The lock mounting assembly according to claim 11, wherein the control means controls provision of the pressurized medium to the port on a side of the piston of the mounting/demounting assembly causing expansion of the mounting/demounting assembly and movement of the rocker arm to a mount position where the second engagement groove engages the second mounting pin and moving the latch to the position substantially closing the first engagement groove and locking the first mounting pin therein.

13. The lock mechanism according to claim 11, wherein the control means controls provision of the pressurized medium to the port on a side of the piston of the mounting/demounting assembly causing contraction of the mounting/demounting assembly such that the latch rotates to open the first engagement groove and the bracket rotates to disengage the second engagement groove from the second mounting pin and simultaneously controls provision of the pressurized medium to the rod side of the piston of the lock mechanism causing a retraction of the rod to unlock the latch.

* * * * *